US006929380B2

(12) United States Patent
Logan et al.

(10) Patent No.: US 6,929,380 B2
(45) Date of Patent: Aug. 16, 2005

(54) CANDLE HOLDER ADAPTER FOR AN ELECTRIC LIGHTING FIXTURE

(76) Inventors: James D. Logan, 23 Currier Rd., Candia, NH (US) 03034; Caren Thornburgh, 23 Currier Rd., Candia, NH (US) 03034

( * ) Notice: Subject to any disclaimer, the term of this patent is extended or adjusted under 35 U.S.C. 154(b) by 0 days.

(21) Appl. No.: 10/686,876

(22) Filed: Oct. 16, 2003

(65) Prior Publication Data

US 2005/0083682 A1 Apr. 21, 2005

(51) Int. Cl.[7] ..... F21L 19/00
(52) U.S. Cl. ..... 362/161; 362/209; 362/254
(58) Field of Search ..... 362/161, 162, 362/163, 209, 254, 457, 458, 226; 431/125, 288, 297

(56) References Cited

U.S. PATENT DOCUMENTS 1,622,347 A * 3/1927 Rhoads ..... 264/263
2,831,331 A * 4/1958 Rodman ..... 431/125
3,561,683 A * 2/1971 Dragan ..... 362/228
3,855,464 A 12/1974 Angelo
5,482,456 A 1/1996 Jwayad et al.
D459,015 S 6/2002 Dolan

OTHER PUBLICATIONS

CANDLEBULB, "The candle for your chandelier", Sep. 9, 2003, 5 pages, http://www.candlebulb.com.

* cited by examiner

*Primary Examiner*—Sandra O'Shea
*Assistant Examiner*—Sharon Payne
(74) *Attorney, Agent, or Firm*—Charles G. Call

(57) ABSTRACT

An adapter for converting an electric light fixture into a candle-burning chandelier. A candle holder adapter includes a cavity at the bottom which fits over and is retained by the vertical light bulb socket support. The candle holder may include an wax catching tray. The candle may be a conventional candle which fits into the candle holder adapter, or may be specially formed to mate with the adapter. The adapter may hold or form a liquid fuel reservior for a fuel burning candle. In an O.E.M. fixture, the vertical light bulb socket support may be removed from the fixture and replaced by a conventional candle or a specially formed candle holder.

22 Claims, 3 Drawing Sheets

CANDLE HOLDER ADAPTER FOR AN ELECTRIC LIGHTING FIXTURE

FIELD OF THE INVENTION

This invention relates to decorative candles and candle holders.

BACKGROUND OF THE INVENTION

With the introduction of the light bulb in 1879, the use of candles and oil burning lamps declined until more recently when a renewed popularity for candles and oil lamps occurred. No longer man's major source of light, candles and oil lamps continue to grow in popularity and use. Today, the natural flame of candles and oil lamps has come symbolize celebration, mark romance, define ceremony, and accent decor.

To mimic the charm of candles and oil lamps, electric lamps have been developed having low output bulbs shaped and sized to resemble candle flames. A common lighting fixture includes a tall cylindrical sleeve shaped like the body of a candle. A small electric bulb with a pointed top, generally in the shape of a flame, screws into the top of sleeve. These bulbs typically have a smaller "candelabra" socket and are widely used in decorative lamp fixtures such as chandeliers and wall sconces. While these "candelabra" fixtures are popular, they fail to totally capture the charm provided by the warm glow of a natural flame.

In order to use real candles with such fixtures, candle holders have been devised to replace the electric bulbs. These "adapters" include consist of a glass bowl forming a candle holder with a threaded base that screws into an empty socket when the electric candelabra lamp is removed. A candle may then be placed in the candle holder bowl and lit for special occasions. Candle holding adapters of this kind are described in U.S. Pat. No. 3,855,464 issued to S. J. Angelo entitled "Electric Light-to-Candle Converter" and in U.S. Pat. No. 5,482,456 issued to J. M. and R. E. Jwayad entitled "Light Fixture Candle Adapter." Although both of these adapters allow candles to be used in light fixtures, they are expensive to manufacture and appear bulky when mounted on top of the socket support column commonly used in electric candelabras.

There is accordingly a need for a more attractive and less expensive arrangement for mounting candles or oil lamps in an electric lamp fixture.

SUMMARY OF THE INVENTION

The present invention provides methods and apparatus for converting an electrical light fixture into a candle holder. The invention is used with conventional fixtures that include one or more light bulb sockets, each of which is mounted at the top of an upright support structure. In accordance with the invention, a candle holder defines a passageway that is open at the bottom and is sized to fit over the upright socket support on the fixture.

The candle holding adaptor may further include wax-catching tray positioned below the candle, and the tray may be either an integral part of the candle holder, or may be detachable from the candle holder.

The passageway within the candleholder may be sized to fit snugly over the decorative sleeve which normally surrounds the socket and its support structure, or the passageway may be sized to fit snugly over the socket and support when the decorative sleeve is removed.

The outside walls of said candle holder may form an extension of the outer surface of said candle and visually appear to be part of said candle, and the outside walls of said candle holder may be coated with a layer of candle wax or the like to simulate the outer surface of said candle. Alternatively, for "pillar" candles having a larger diameter, the portion of the candleholder forming the passageway may be placed inside a cavity at the bottom of the candle.

The candle and candle holder may be a single integrated part in which the candleholder forms an extension to the bottom of the candle and defines the open hollow passageway at the bottom that may be placed over the and retained by the socket support on the electrical fixture. Alternatively, the candle may be separate from the candle holder, and be inserted into and retained by the candle holder. The candle may burn solid fuel, such as candle wax, or a liquid fuel held in a liquid fuel reservoir which is either an integral part of the candle holder, or part of a separate liquid fuel burning candle that is inserted into and retained by the candle holder. Unless otherwise required by the context, the term "candle" as used herein should be understood to refer to either a conventional candle constructed of a solid fuel material that melts as the candle burns or a candle that burns a liquid fuel held in a fuel reservoir.

The invention enables a homeowner who is entertaining to replace the light bulbs in a electric chandelier with real candles. In this way, the homeowner may enjoy the convenience of electric lighting from such a fixture but, on special occasions, use that same fixture to provide candlelight.

These and other features and advantages of the present invention may be more clearly understood by considering the following detailed description of the invention.

BRIEF DESCRIPTION OF THE DRAWINGS

In the detailed description which follows, frequent reference will be made to the attached drawings, in which.

DETAILED DESCRIPTION

Figure 1:
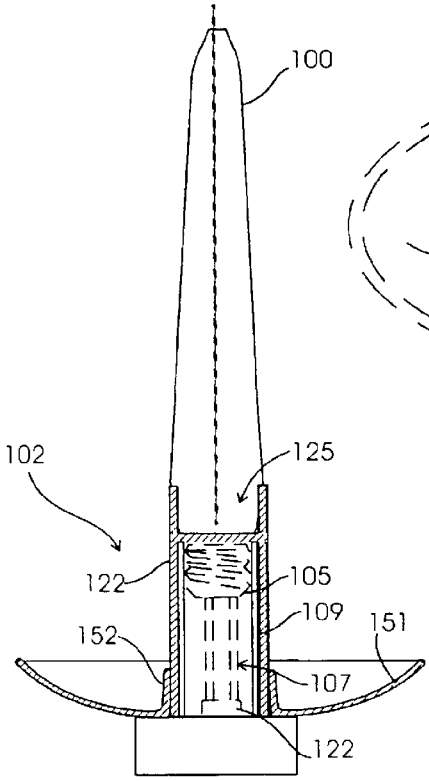
FIG. 1 is a cross-sectional view of a candle holder adapter with a detachable wax catching tray.
Figure 2:
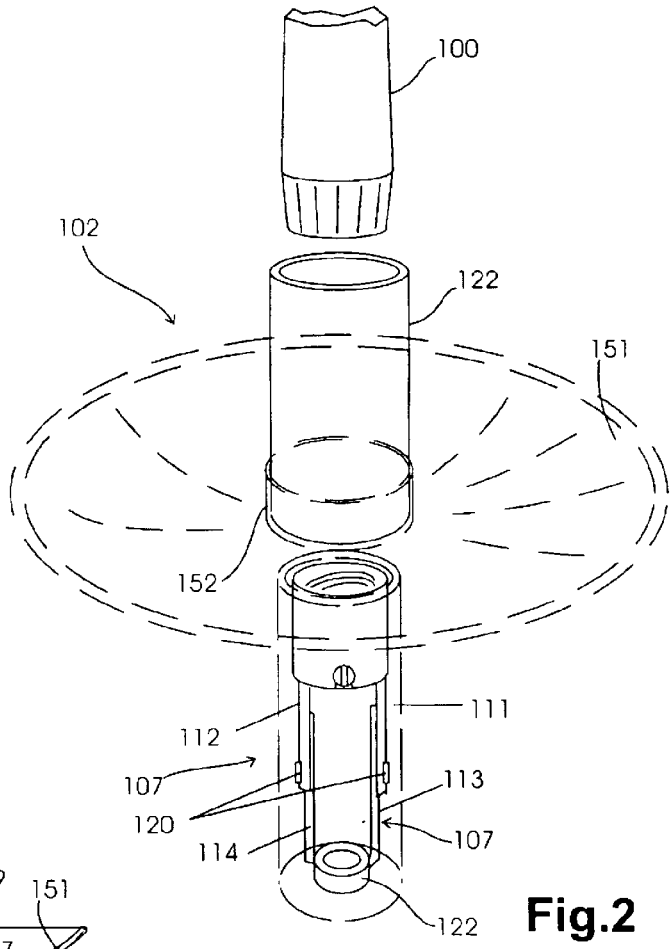
FIG. 2 is a perspective, exploded view of the adapter shown in FIG. 1.

The present invention permits candles to used with an existing electrical fixture. A first illustrative embodiment of the invention is shown in FIGS. 1 and 2 and comprises a taper candle 100 that is inserted into and retained by a candle holder adapter indicated generally at 102. The candle 100 and the candle holder adapter 102 replace the electric light bulb (not shown) that is normally screwed into a socket 105 at the top of an upright socket support structure indicated generally at 107 which is surrounded by a decorative sleeve 109.

Most electric lamp chandeliers use candle-like bulbs having a standard threaded "candelabra base" held by a standard socket assembly of the kind shown at 105 and 107 in FIGS. 1 and 2. The bulb screws into the female threaded electrical socket 105 mounted at the top of an upright support structure 107 consisting of two downwardly extending channels 111 and 112 which receive the two upwardly extending prongs 113 and 114 respectively of a base bracket. The upper channels 111 and 112 in the socket assembly can slide up and down on the base bracket to provide a height adjustment, and is then held in place by tightening two set screws 120. The bottom bracket is held to the lamp by a standard size threaded brass tube (not shown) which passes through a brass bezel ring 122 at the bottom of the base bracket. The lamp wires (not shown) pass through the tube and attach to the lamp socket with connection screws. The decorative sleeve 109 covers the socket, wires and support structure. A smaller insulating sleeve (not shown) inside the decorative sleeve 109 is also commonly included to allow the decorative sleeve 109 to be removed without exposing the ends of the wires which would otherwise create a shock hazard. The outer sleeve 109 is typically white or cream colored, and simulates the appearance of a candle. The candle socket assembly consists of standard parts that can be purchased in quantity for about two dollars and used to repair most candelabra fixtures.

The candle adaptor shown in FIGS. 1 and 2 is adapted to mount a standard candle on an electric candelabra fixture, replacing the light bulb. The candle holder comprises a tubular body section 122 forming a receptacle 125 at the top which receives and retains a candle, such as the "taper" candle 100 shown in FIGS. 1 and 2. An interior horizontal wall section at 130 seen in FIG. 1 forms a "floor" for the candle receptacle 125, preventing wax or other debris from contaminating the electrical socket assembly. The underside of the wall section 130 further provides a support surface which engages the top of the socket assembly to support the candle and candleholder vertically.

The inside diameter of the candle holder's body section 122 is preferably sized to fit over the decorative sleeve 109 in the existing fixture. Alternatively, the inside diameter of the body section 122 may be made substantially equal to the inside diameter of the sleeve, in which case both the light bulb and the decorative sleeve 109 are first removed from the fixture before the body section 122 is placed over the socket support structure. After the candle adaptor is in place, the sidewalls of the body section 122 provide lateral support for the adaptor with respect to the fixture.

A wax catching tray may be attached to, or form an integral part of, the candle holder adaptor as illustrated in FIGS. 1 and 2. The wax catching tray used in the embodiment of FIGS. 1 and 2 comprises a concave disk 151 with a central circular opening to which an annular sleeve 152 is attached. The inside diameter of the annular sleeve 152 is sized to form a press fit with outside surface of the tubular body section 122. By making the wax catching tray detachable from the body section of the candle holder adaptor, the homeowner retains the option of using the candle holder without the tray. By attaching the wax catching tray to the candle holder with a sliding, frictional engagement, the tray may be moved vertically up or down with respect to the body section 122, facilitating installation in some fixtures having structural parts which may be positioned near the base of the socket support.

The side walls of the body section 122 have an outside diameter approximately equal to that of the base of the candle 100. As a result, the body section 122 presents the visual appearance of being an extension of and being part of the candle. To enhance this effect, the sidewalls of the body section 122 may be the same color as the candle, and be coated with a material (such as candle wax) which simulates the appearance of the candle.

Figure 3:
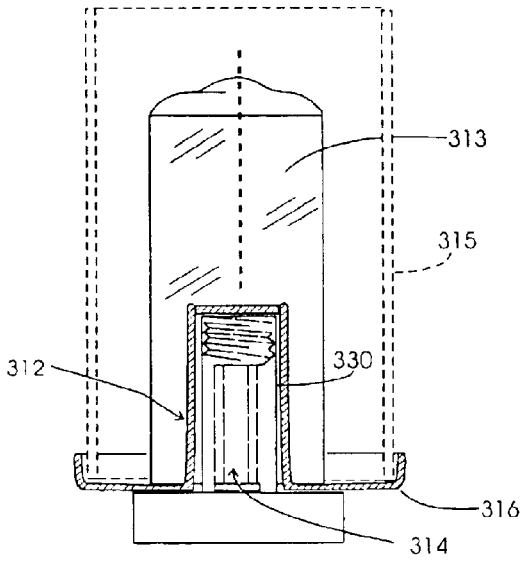
FIG. 3 is a cross-sectional view of a pillar candle holding adapter with an attached wind shield.

A second embodiment of the invention is shown in FIG. 3. In this arrangement, the candle holder adaptor 312 and the candle 313 are formed as an integrated structure, and the wax catching tray 316 is also an integrated part of the adaptor. The candle 313 is a shorter and fatter than the taper candle shown in FIG. 1. The adaptor is formed by a single molded plastic part which defines a tubular body section 312 and the tray 316. The interior of the body section 312 defines a hollow passageway at 314 that is open at the bottom to receive the upright socket support structure 330. As discussed in connection with the embodiment of FIGS. 1 and 2, the inside diameter of the passageway 314 may be sized to fit over the decorative sleeve on a conventional socket support structure, or may be made smaller to fit over the support structure with the decorative sleeve removed.

In the arrangement shown in FIG. 3, the body section 312 is inserted into a cylindrical cavity formed in the bottom of a candle 313 which has an outside diameter substantially larger than that of the body section 212. The wax candle 313 may be formed by placing a cylindrical mold (not shown) over the body section 312 and on top of the tray 316. After wax is poured into the mold and hardens, the mold is removed to form the integrated candle and candle holder as seen in FIG. 3. Alternatively, the candle 313 may be separately molded with a cylindrical cavity preformed in its base, and the tubular body section 312 may then be inserted into the candle cavity. In either case, only the exterior of the candle 313 and the wax catching tray 316 are visible when the assembly is placed over the socket support structure 330 on the electrical fixture.

The wax catching tray 316 has a raised peripheral rim which retains an optional, removable glass wind shield 340 of the kind used in "hurricane lamps." The wind shield is particularly useful when the electric fixture is located where drafts may cause the flame to be extinguished or burn irregularly.

Note that, in an arrangement of the type shown in FIG. 3, the candle wax should be substantially opaque to prevent the outline of the interior body section 312 from being visible—a problem that becomes more severe as the candle burns down and the flame is near the body section.

Figure 4:
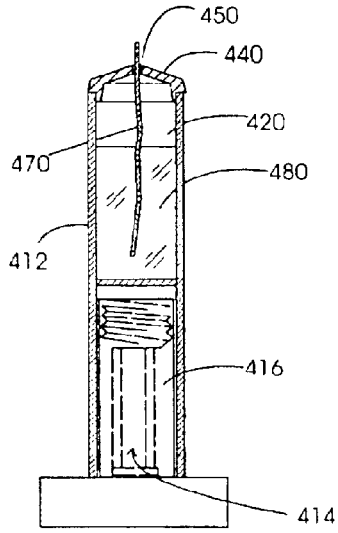
FIG. 4 is a cross-sectional view of a candle holder adapter which burns a liquid fuel.

FIG. 4 depicts still another embodiment in which the hollow body section 412 of a candle holder adaptor forms a passageway 414 at its bottom to receive the upright socket support structure 416 of the lamp fixture and also forms a liquid fuel reservoir at 420 which holds lamp oil or the like as indicated at 480. A sealing cap at 440 fits over the top of the fuel reservoir 420 to retain the fuel 480, and includes a central hole at 450 through which a wick 470 extends inwardly into the fuel 480 in the reservoir 420. The sidewalls surrounding the fluid reservoir 420 may be transparent or translucent to reveal how much fuel remains in the reservoir. Note that the oil lamp adapter shown in FIG. 4 has no wax catching tray, since dripping wax is not a problem.

It should be noted that, by making the passageway defined by the candle holder deeper, an adaptor can be constructed which can be placed over both the socket support pillar and the light bulb. This alternative, though somewhat easier to use, limits the amount of wax that may be consumed and hence reduces the available "burn time" for the candle.

Because the candle adaptor is commonly used in dining room chandeliers and is replacing relatively bright electric lighting, it is important to use bright burning wax and wick combinations. To achieve this, the candle may advantageously be provided with an enlarged wick, or two or more wicks, in order to produce more light. A liquid fuel burning candle such as the oil lamp adaptor shown in FIG. 4 can employ an enlarged wick or multiple wicks to achiever bright light.

Although the arrangements that have been described are well adapted for use with existing light fixtures, the same structures may be used in an O.E.M. (original equipment manufactured) light fixture which is intended for both electrical and natural flame use. In such a fixture, the wax catching tray may be sized to nest within a decorative tray that is permanently mounted to the lamp. The wax catching tray in the adaptor may be constructed of "dishwasher safe" material so that it may be easily cleaned, or may be a discardable annular sheet made of wax paper or other material that can be simply discarded and replaced with a fresh tray.

Figure 5:
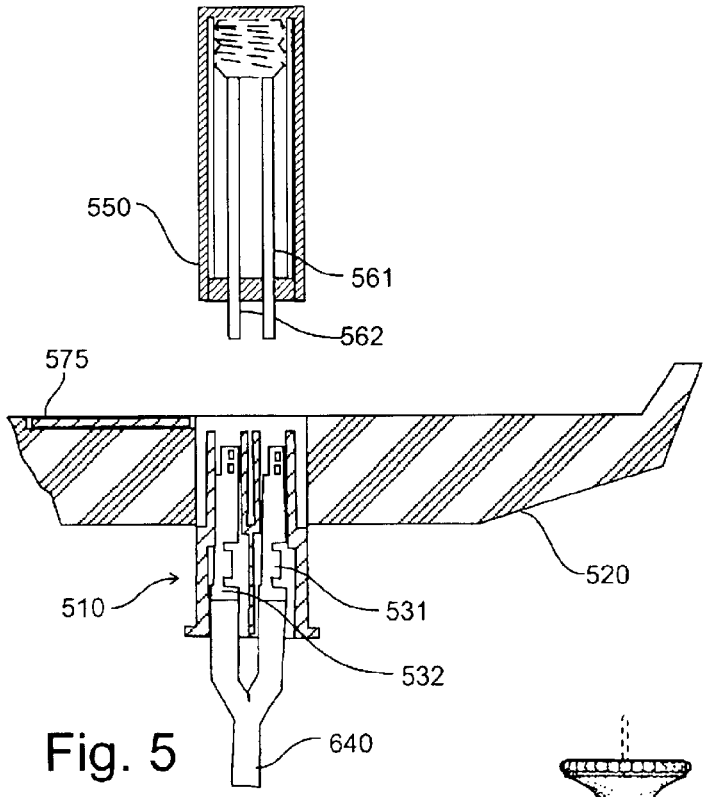
FIG. 5 is a cross-sectional view of a chandelier employing a removable electric candle which can be replaced by a wax or oil-burning candle.

In an O.E.M. fixture, the "electric candles" (that is, the candle-like vertical column that supports the light bulb, and the bulb) may be removable so that they can be replaced by wax or oil burning candles. As shown in FIG. 5, a socket assembly 510 is formed incorporated into a wax catching tray 520. The assembly 10 holds two electrical connectors 531 and 532, each of which connects to one wire of an electrical supply cord 540. An electric candle assembly comprising an upright section 550 which includes a light bulb socket (not shown) at its upper end includes a pair of electrical pin connectors 561 and 562 which insert into and establish an electrical connection with the connectors 631 and 632 in the fixture.

The electric candle assembly 550 may be removed from the socket in the 510 and replaced by a candle holder having a base portion sized and shaped to fit into the socket 510. The candle holder may be inserted into the base of a pillar candle as shown in FIG. 3, or may be the base of a liquid fuel candle as shown in FIG. 4. As noted above, the candle holder may include its own wax catching tray which is adapted to be nested within the tray 520 formed in the fixture.

Alternatively, a conventional pillar candle may be placed directly upon the wax catching tray 520. To protect the electrical socket 510 from being contaminated by wax from the candle, a moveable cover seen at 575 may be positioned over the socket 510 before a candle is placed on the tray 520, and then moved to the side again to permit the base of the electric candle assembly 550 to be inserted into the socket.

Figure 6:
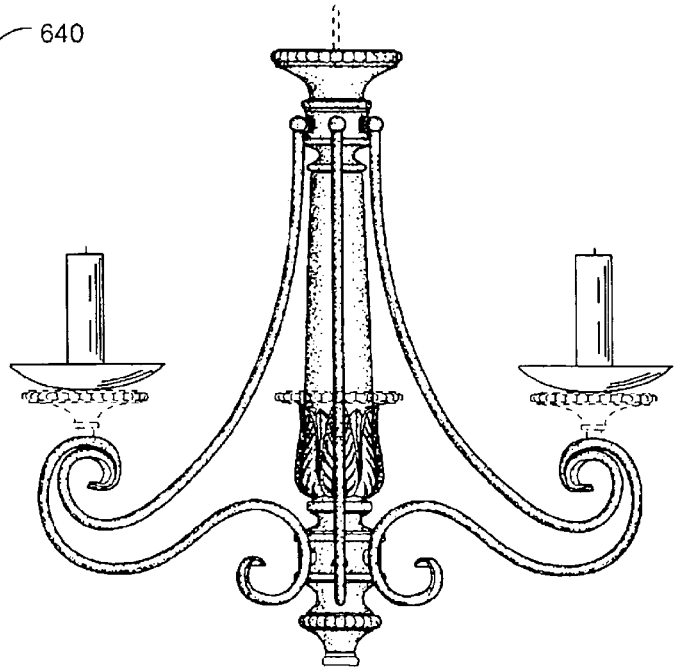
FIG. 6 is a pictorial view of a chandelier fitted with candle holder adapters embodying the invention.

FIG. 6 shows a conventional fixture with candle holder adaptors provided with wax catching trays placed over the "electric candles" in the fixture. In and O.E.M. fixture of the type described above, the wax catching tray of the fixture, which forms a decorative function when electric candles are used, may be used to support a conventional candle, a holder for a conventional candle as described in connection with FIGS. 1–3, or support for a liquid fuel burning candle as shown in FIG. 4.

CONCLUSION

It is to be understood that the methods and apparatus which have been described above are merely illustrative applications of the principles of the invention. Numerous modifications may be made by those skilled in the art without departing from the true spirit and scope of the invention.

What is claimed is:

1. The method of mounting a candle on an existing electrical fixture in which an electric light bulb is normally screwed into a threaded light bulb socket at the top of an upright columnar standard comprising, in combination, the steps of:

constructing a candle holder that forms a hollow passageway open at the bottom of said candle holder, removing said light bulb from said light bulb socket, and placing said candle holder on said fixture such that said columnar standard and said threaded light bulb socket is inserted into said hollow passageway to laterally support said candle holder.

2. The method of mounting a candle on an existing electrical fixture as set forth in claim 1 wherein said candle holder further comprises a wax-catching tray positioned below a candle held by said candle holder.

3. The method of mounting a candle on an existing electrical fixture as set forth in claim 2 wherein said wax catching tray is an integral part of said candle holder.

4. The method of mounting a candle on an existing electrical fixture in which an electric light bulb is normally screwed into a socket at the top of an upright columnar standard as set forth in claim 2 wherein said wax catching tray is detachable from the remainder of said candle holder.

5. The method of mounting a candle on an existing electrical fixture as set forth in claim 1 wherein said candle holder supports a candle and the outside walls of said candle holder form an extension of the outer surface of said candle and visually appear to be part of said candle.

6. The method of mounting a candle on an existing electrical as set forth in claim 5 wherein said outside walls of said candle holder are covered with a coating that simulates said outer surface of said candle.

7. The method of mounting a candle on an existing electrical as set forth in claim 1 wherein said candle consists of a liquid fuel reservoir formed in said adapter and a wick extending into said fuel reservoir.

8. The method of mounting a candle on an existing electrical fixture in which an electric light bulb is normally screwed into a threaded light bulb socket at the top of an upright columnar standard which is surrounded by a decorative sleeve, said method comprising, in combination, the steps of:

attaching a candle holder to said candle, said candle holder including means for supporting a candle and further being formed to define a hollow passageway that is open at the bottom and has an inside dimension approximately equal to the inside dimension of said decorative sleeve, removing said light bulb from said threaded light bulb socket, removing said sleeve from said upright standard, and placing said candle holder on said fixture such that said column standard and said threaded light bulb socket is inserted into said hollow passageway to laterally support said candle holder.

9. The method of mounting a candle on an existing electrical fixture as set forth in claim 8 wherein said candle holder further comprises a wax-catching tray below said candle.

10. The method of mounting a candle on an existing electrical as set forth in claim 9 wherein said wax catching tray is an integral part of said candle holder.

11. The method of mounting a candle on an existing electrical fixture as set forth in claim 9 wherein said wax catching tray is detachable from the remainder of said candle holder.

12. The method of mounting a candle on an existing electrical fixture as set forth in claim 8 wherein the outside walls of said candle holder form an extension of the outer surface of said candle and visually appear to be part of said candle.

13. The method of mounting a candle on an existing electrical fixture as set forth in claim 12 wherein said outside walls of said candle holder are covered with a layer of candle wax to simulate said outer surface of said candle.

14. An adaptor for converting an electrical light fixture into a candle holder, said electrical light fixture including a threaded light bulb socket for receiving a light bulb mounted at the top of an upright support structure, said adaptor comprising, in combination, a candle holder attached to a candle, said candle holder including means for supporting a candle and further defining a passageway that is open at the bottom and sized to fit over said upright standard and said threaded light bulb socket to laterally support said candle holder on said light fixture.

15. An adaptor for converting an electrical light fixture into a candle holder as set forth in claim 14 wherein said candle holder further comprises a wax-catching tray below said candle.

16. An adaptor for converting an electrical light fixture into a candle holder as set forth in claim 15 wherein said wax catching tray is an integral part of said candle holder.

17. An adaptor for converting an electrical light fixture into a candle holder as set forth in claim 15 wherein said wax catching tray is detachable from the remainder of said candle holder.

18. An adaptor for converting an electrical light fixture into a candle holder as set forth in claim 14 wherein the outside walls of said candle holder form an extension of the outer surface of said candle and visually appear to be part of said candle.

19. An adaptor for converting an electrical light fixture into a candle holder as set forth in claim 18 wherein said outside walls of said candle holder are covered with a layer of candle wax to simulate said outer surface of said candle.

20. The method of mounting a candle on an existing electrical fixture in which an electric light bulb is normally screwed into a threaded light bulb socket at the top of an upright columnar standard comprising, in combination, the steps of:

constructing a candle assembly that comprises a candle having a cylindrical cavity in its base and a hollow sleeve member inserted into said cavity to form a hollow passageway into said candle, said hollow passageway being open at the bottom to receive said upright columnar standard and said threaded light bulb socket, removing said light bulb from said light bulb socket, and placing said candle assembly on said fixture such that said columnar standard and said threaded light bulb socket is inserted into said hollow passageway to laterally support said candle assembly.

21. The method of mounting a candle on an existing electrical fixture as set forth in claim 20 wherein said candle assembly further comprises a wax-catching tray which is attached to and extends radially outward from the perimeter of said hollow sleeve member.

22. The method of mounting a candle on an existing electrical fixture as set forth in claim 21 wherein said hollow sleeve member and said wax catching tray are formed by a single plastic part.

* * * * *